United States Patent [19]

Hauner et al.

[11] Patent Number: 4,914,785

[45] Date of Patent: Apr. 10, 1990

[54] DEVICE TO FEED FIBER SILVERS

[75] Inventors: Friedrich Hauner; Heinrich Spangenberger, both of Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 227,350

[22] Filed: Aug. 2, 1988

[30] Foreign Application Priority Data

Aug. 5, 1987 [DE] Fed. Rep. of Germany ..... 3725904

[51] Int. Cl.[4] ..... D01G 31/00; D01H 13/16; B65H 57/00

[52] U.S. Cl. ..... 19/0.25; 57/81; 226/196; 242/157 R

[58] Field of Search ..... 19/0.25, 0.2, 0.21, 19/0.22; 57/81; 226/196; 242/157 R, 37 R; 200/61.18

[56] References Cited

U.S. PATENT DOCUMENTS

| | | | |
|---|---|---|---|
| 3,916,687 | 11/1975 | Loepfe | 28/187 X |
| 4,229,628 | 10/1980 | Bogucki | 19/0.25 X |
| 4,428,097 | 1/1984 | Adamson | 19/0.25 |

FOREIGN PATENT DOCUMENTS

| | | | |
|---|---|---|---|
| 0071141 | 9/1983 | European Pat. Off. | 19/0.25 |
| 189336 | 11/1966 | U.S.S.R. | 19/0.25 |
| 714936 | 9/1954 | United Kingdom | 19/0.25 |
| 2092187 | 8/1982 | United Kingdom | 19/0.25 |

*Primary Examiner*—Werner H. Schroeder
*Assistant Examiner*—Sara M. Current
*Attorney, Agent, or Firm*—Dority & Manning

[57] ABSTRACT

A device used to feed fiber slivers to a processing machine with at least one sliver guide. The sliver guide is provided with a guiding surface over which the fiber sliver is guided. The guiding surface also serves as a sliver monitoring device.

The sliver guide is produced in a process in which the housing of the sliver guide, standing on its head, together with its guiding surface, is clamped over a die. A sensor is inserted into the housing from the side opposite the guiding surface and is embedded therein in a casting compound.

14 Claims, 2 Drawing Sheets

FIG.1
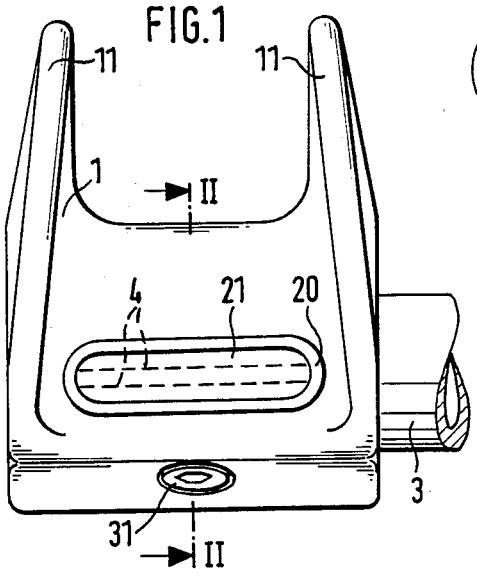
FIG. 2
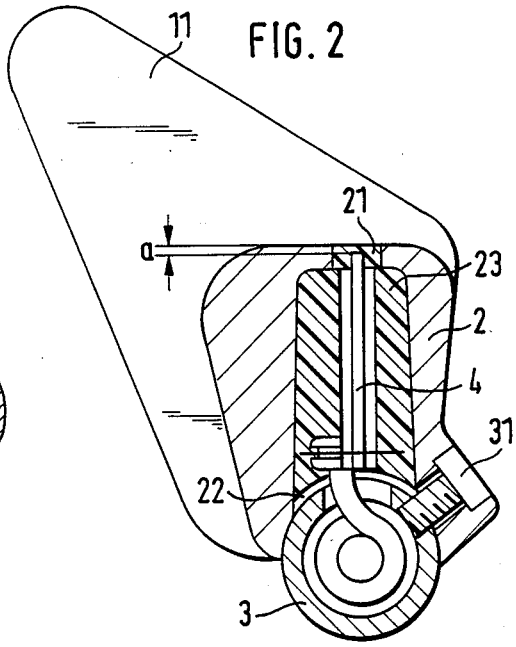
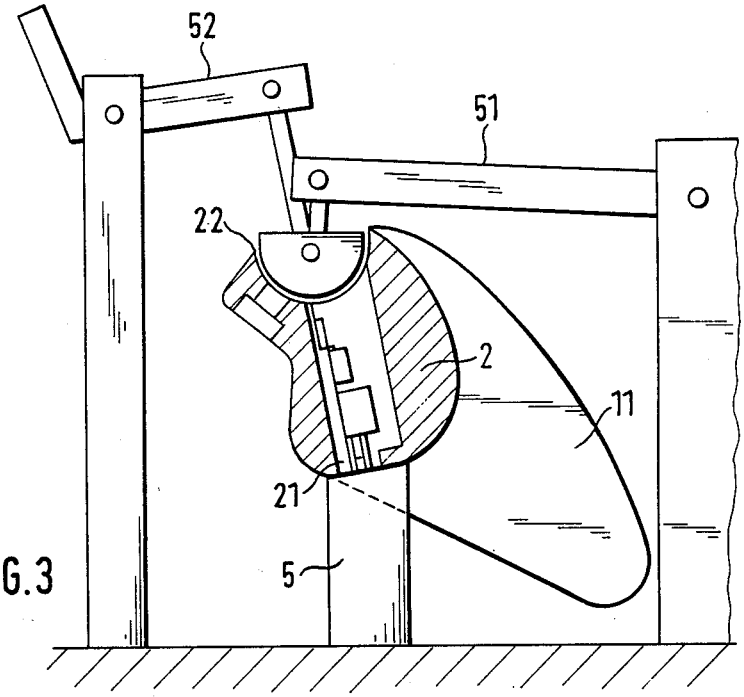
FIG.3

DEVICE TO FEED FIBER SILVERS

BACKGROUND OF THE INVENTION

The instant invention relates to a device for feeding fiber slivers to a processing machine with at least one sliver guide equipped with a guiding surface over which the fiber sliver is guided. The invention also includes a process for the production of a sliver guide.

A current procedure deflects running fiber slivers by means of sliver guides into a horizontal position while they are still in the area of the spinning can, and feeds them in this position to a processing machine, e.g. a drawing frame. A monitoring device is disposed before the machine intake to ensure that the machine is stopped in case of sliver breakage, before the sliver end runs into the machine. Contact rollers, photoelectric barriers and sensors are used as monitoring devices.

The disadvantages of such monitoring devices are that the bare sliver monitors, in addition to the danger of being damaged, risk being damaged by fly. Further, in setting up the fiber sliver containers in a long row, the operator must cover a long distance, for instance to bring the broken fiber sliver from the hindmost container forward to the machine intake, to combine it with the other broken end and to restart machine. This increases the machine stoppage times.

SUMMARY OF THE INVENTION

It is an object of the instant invention to avoid these disadvantages, and to create, in a simple manner, a reliable sliver monitoring device that increases the effectiveness of the machine.

The object is attained by the invention in that the guiding surface also serves as a monitoring device for the sliver.

The sliver guide also assumes the function of a sliver monitor so that early detection of sliver breakage is possible with the normal arrangement of the first sliver guide. As seen in the direction of sliver movement, the guide is downstream of the spinning can contaning the fiber sliver.

In a further embodiment of the invention, the monitoring device is enclosed in the housing of the sliver guide, which is provided with a guiding surface, and which has an opening on the side of said guiding surface. The monitoring device is thus protected from fiber fly damage. The installation of the monitoring device within the housing is facilitated by the fact that the housing also has an opening on the side opposite the guiding surface. A sensor, embedded within a casting compound poured into the housing, is preferably used as the sensor which is connected through the electric connections to a control to stop the machine when the sliver breaks. The sensor shall, preferably, be one functioning on basis of capacitance, making it possible to detect sliver breakages which occur after the fiber sliver has passed the sliver guide, and after the rear sliver end, as seen in running direction, remain lying on the sliver guide as a result of the breakage. Improved sliver guidance and scanning is achieved because the guiding surface is in form of a plane. The opening in the guiding surface is made in form of a slit extending transversely to the running direction of the fiber sliver. This makes it possible to achieve scanning of the fiber sliver over a wide surface.

In another embodiment of the invention, the housing and the casting compound possess nearly the same physical properties. In this way no gaps, in which fibers can accumulate, open up between casting compound and housing during heat expansion, for instance.

If the monitoring device is installed in immediate proximity of a spinning can containing the fiber sliver, the breakage of the fiber sliver or the end of the fiber sliver are quickly detected and the operator only has to cover a short distance to repair the break.

In a further embodiment of the invention, the sensor is electrically connected to a switching device. The switching device preferably contains the activating functions for remote control of the machine. If the switching device is installed near the monitoring device, the operator is able to restart the machine more rapidly after the elimination of a defect in the fiber sliver, as he will have to cover shorter distances to restart the machine. If the electric connections between sensor, switching device and switch-off control are installed in essentially closed channels, the risk of damage is reduced. If the triggering of the monitoring device by an optical signal transmitter can be indicated, this has the advantage of making it possible to quickly identify a faulty fiber sliver. If the optical signal transmitter is installed in immediate proxity of the monitoring device, the operator is able to reach the damaged spot in the fiber sliver by the shortest route.

The invention further relates to a process for the production of a sliver guide with an integrated scanning device, characterized in that the housing is clamped in an upside-down position over a die and the sensor is placed into the housing from the side opposite the guiding surface and embedded in a casting compound.

By embedding the sensor "upside-down" any air bubbles that may remain in the casting compound are caused to move away from the guiding surface, which at the same time becomes a scanning surface so that a homogenous structure can be formed at that location.

For the purpose of removing air pockets it is advantageous to pour only a portion of the casting compound into the housing at first, to free it of air bubbles and then to install the sensor in the housing before filling in the remaining casting compound. To ensure trouble-free running of the fiber sliver over the guiding surface of the sliver guide, said guiding surface is polished after the casting compound hardens.

BRIEF DESCRIPTION OF THE DRAWINGS

An embodiment of the invention is described below in reference to the drawings, in which:

FIG. 1 is a top front perspective view of the sliver guide of the invention;

FIG. 2 is a sectional view, taken through the sliver guide, along line II—II of FIG. 1;

FIG. 3 illustrates a device for the insertion of a monitoring device into the sliver guide, in a side view and partially in a section.

DETAILED DESCRIPTION OF THE DRAWINGS

Figure 4:
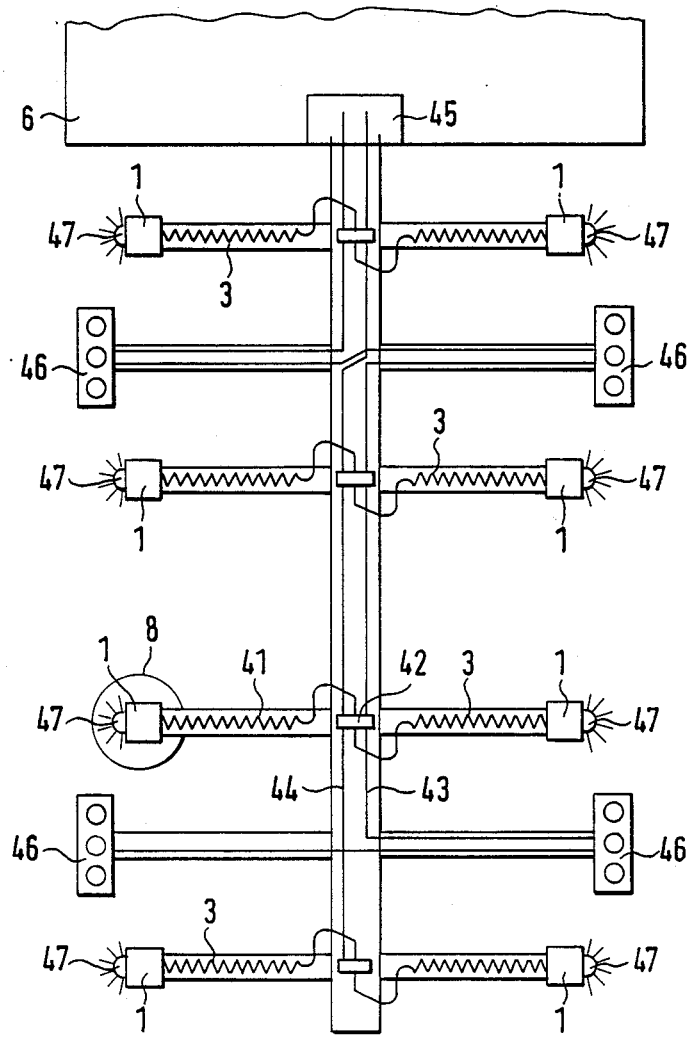
FIG. 4 is a top view of a feeding frame with a plurality of the sliver guides mounted on it.

FIGS. 1 and 2 show a sliver guide 1 with a housing 2, attached to a holding pipe or bar 3, by means of screws 31. A polished guiding surface 20, over which the fiber sliver glides en route to a processing machine, e.g. a drawing frame, is installed on the housing 2. Slippage of the fiber sliver from the sliver guide 1 or from the guiding surface is prevented by the side guards 11 which limit the guiding surface 20 on both sides. The guiding surface 20 is made in form of a plane surface.

Housing 2 is provided with an opening in form of a slit 21 near the guiding surface 20. Slit 21 extends transversely to the running direction of the fiber sliver up to the proximity of the lateral guards 11. Housing 2 is also provided with an opening 22 on the end of housing 2 opposite the guiding surface 20, allowing for free access to the interior of housing 2.

A monitoring device which ascertains the presence of the fiber sliver and checks its running is set into the guiding surface 20. The monitoring device is set into housing 2 and is protected from dirt and damage. A sensor 4, functioning on basis of capacitance, is the preferred monitoring device. The sensor 4 is embedded in a casting compound in housing 2, and extends with its one end into slit 21 which is filled with casting compound 23. The distance "a" between the upper edge of the sensor 4 and the upper edge of the guiding surface 20 is not greater than 1.5 mm, so that reliable triggering of the sensor 4 is ensured. In this embodiment, the sensor 4 is covered by a casting compound 23. It is, however, also possible to provide a wall of housing 2 over the sensor 4. This has the advantage of avoiding any points of impact on the guiding surface 20 between the casting compound 23 and housing 2. Covering the sensor by the guiding surface ensures that the sensor ascertains the presence of a fiber sliver without being subjected to wear. If the sensor 4 is flush with the guiding surface, i.e. if the distance "a"=0 mm, care must be taken that the transition between sensor 4 and casting compound 23 or housing 2 is very smooth so that no fibers can catch there. It is, however, also essential for proper response of the sensor 4 that the housing 2 of the sliver guide 1 and the casting compound 23 possess substantially identical physical properties, especially with respect to expansion, strength, and reaction to temperature changes, for example by pairing off materials such as aluminum and araldite.

The sensor 4 is embedded in the housing 2 of the sliver guide 1 by means of a device shown in FIG. 3. The sliver guide is placed with its guiding surface containing slit 21 on a die 5 which also has a plane surface, and is pressed down on the die by means of a clamping device 51. A portion of the casting compound 23 is then introduced through the opening 22 in a housing 2 which is opposite slit 21, so that slit 21, and part of housing 2 are filled with the casting compound 23. This first portion of the casting compound 23 is suitably introduced by means of a brush which eliminates air pockets in the casting compound 23.

After application of this base layer, sensor 4 is set into housing 2 which is then filled with the casting compound 23. Precise positioning of the sensor 4, as it is set into the housing 2, is ensured by a holding device 52. By embedding the sensor 4 "head down" in housing 2, air bubbles present in the casting compound 23 rise and move away from the guiding surface 21, which is now also a scanning surface, so that a homogenous mass is provided at that point. After the hardening of the casting compound, the guiding surface 20 is polished so that no fibers may be separated from the fiber sliver.

FIG. 4 shows a feeding frame, serving to feed a plurality of fiber slivers to a drawing frame or to another processing machine. Four holding pipes 3 are attached to a central pipe, extending in the direction of the fiber sliver's path. The sliver guides 1, with the integrated sliver monitor are located at both ends of holding pipes 3. The sliver guides 1 are located above, or at least in immediate proximity of spinning cans 8 filled with fiber slivers, of which only one is shown.

The fiber sliver taken from one of the spinning cans 8 is fed over the guiding surface 20 of sliver guide 1 and, depending upon the distance between the spinning can and the machine, over additional sliver guides, en route to the processing machine 6. No monitoring devices are inserted into the additional sliver guides (not shown), however, in order to save expenses.

The sensors 4, integrated into the sliver guides 1, are connected to a switch-off device 45, and to switching devices 46, on the feeding frame by means of electric connections 41, 42, 43 and 44, which are installed within the holding pipes 3 and within the central pipe 7 so as to be protected from dirt and damage.

In case of fiber sliver breakage between spinning can 8 and sliver guide 1, the sensor 4 detects the absence of the sliver as the sliver end passes and transmits a signal to the switch-off device 45 which stops the drive motor of the machine. Sensor 4, furthermore, recognizes sliver breakage occurring between the sliver guide 1 and machine 6, i.e. when the fiber sliver no longer runs over the guiding surface 20 but remains laying on it. The sensor 4 then transmits a signal to the switch-off device to switch off the machine. In any case, the two sliver ends remain so close together after a sliver breakage thanks to the integration of the monitoring device within the sliver guide 1, located in immediate proximity of the spinning can 8, that they can easily be seized by the operator and quickly spliced together. The machine 6 can, therefore, be put back into operation in the briefest possible time by activating one of the switching devices 46. The switching device 46 contains a conventional start switch for the remote control of the machine so that the operator can start up the machine 6 from the location at which the sliver breakage has occurred. For the operator to cover short distances, and for the stoppage time of the machine 6 to be as brief as possible, the switching device 46 is installed close to the sliver guide 1 in which sensor 4 is located.

The optical signal transmitters 47 are installed in the immediate proximity of the monitoring device. When the monitoring device is triggered they indicate that the operator must look for a fiber sliver breakage at that location. This configuration of the device, further reduces the stoppage time of the machine 6.

The arrangement of the switching devices 46 is selected in FIG. 4 in such manner that each switching device 46 can be triggered by two monitoring devices.

What is claimed is:

1. A sliver guiding and monitoring device, for guiding fiber sliver en route from a sliver supply to a sliver processing machine, and for monitoring the passage of said sliver over said guide, comprising:

(a) a housing, adapted to be supported on said sliver processing machine, adjacent to said sliver supply;

(b) a sliver guiding surface disposed on said housing for guiding said sliver en route from said sliver supply to said sliver processing machine; and (c) sliver monitoring means embedded within said housing, adjacent to said guiding surface, for monitoring the passage of said sliver over said sliver guiding surface.

2. A device as set forth in claim 1, wherein said monitoring means is embedded within an opening filled with a casting compound in said housing.

3. A device as set forth in claim 2, wherein said opening extends from said sliver guiding surface to the side of said housing opposite said guiding surface.

4. A device as set forth in claim 2, wherein said monitoring device comprises said sensor embedded in said casting compound within said opening, and is connected to a switch means for stopping said sliver processing machine.

5. A device as set forth in claim 4, wherein said sensor is a capacitate device.

6. A device as set forth in claim 1, wherein said sliver guiding surface is planar.

7. A device as set forth in claim 2, wherein said opening is provided in said sliver guiding surface in the form of a slit which extends transversely of the running direction of the fiber sliver across said guide surface.

8. A device as set forth in claim 4, wherein said housing and said casting compound possess substantially identical thermal properties.

9. A device as set forth in claim 1, wherein said sliver guiding and monitoring device is embedded in the immediate proximity of the sliver supply.

10. A device as set forth in claim 1, wherein a switch device for stopping said sliver processing machine is disposed adjacent to said sliver guiding and monitoring device.

11. A device as set forth in claim 10, wherein said switching device contains means for the remote control of said sliver processing machine.

12. A device as set forth in claim 1, wherein said monitoring device is connected to an optical signal transmitter.

13. A device as set forth in claim 12, wherein said optical signal transmitter is disposed in proximity to the monitoring device.

14. A sliver guiding and monitoring device, comprising:

(a) a housing, adapted to be supported on a textile fiber sliver processing machine, adjacent to a supply of sliver;

(b) a silver guiding surface disposed on said housing for guiding sliver from said sliver supply en route to said sliver processing machine;

(c) an elongated slit in said guiding surface, extending transversely of the direction said slivers cross said guiding surface;

(d) a cavity within said housing, extending from said slit to a surface opposite said guiding surface;

(e) sliver monitoring means disposed within said cavity, extending, at least partially into said slit; and (f) a hardened casting compound disposed within said cavity and said slit, surrounding said monitoring means and maintaining said monitoring means in a predetermined position in said cavity and said slit.

* * * * *